US005947447A

United States Patent [19]

Sorensen

[11] Patent Number: 5,947,447

[45] Date of Patent: Sep. 7, 1999

[54] AUTOMOTIVE SERVICE JACK

[75] Inventor: Bradford Tyler Sorensen, Glendale, Calif.

[73] Assignee: Alltrade Inc., Long Beach, Calif.

[21] Appl. No.: 08/953,544

[22] Filed: Oct. 21, 1997

Related U.S. Application Data

[63] Continuation-in-part of application No. 08/790,917, Jan. 29, 1997, abandoned.

[51] Int. Cl.[6] ..... B66F 3/24

[52] U.S. Cl. ..... 254/1; 254/8 B

[58] Field of Search ..... 359/838; 254/2 B, 254/7 B, 1, 6 B, 8 B, 10 B, 120, 124; 269/11; 89/57.29

[56] References Cited

U.S. PATENT DOCUMENTS

| | | | |
|---|---|---|---|
| 2,133,839 | 10/1938 | Addor . | |
| 2,188,677 | 1/1940 | Dickinson . | |
| 2,219,903 | 10/1940 | Pfauser . | |
| 2,580,699 | 1/1952 | Pfetzing . | |
| 3,936,668 | 2/1976 | Siebel . | |
| 4,277,048 | 7/1981 | Okuda | 254/8 B |
| 5,345,845 | 9/1994 | Myers | 81/57.29 |

*Primary Examiner*—Robert C. Watson
*Attorney, Agent, or Firm*—Robert R. Thornton

[57] ABSTRACT

A service jack includes a mirror attached to the jack's lift arm adjacent the jack's saddle so as to be able to provide a continuous reflected image for the jack operator as the lift arm is moved from its lowered position to its raised position of the sector of space above the saddle which includes a selected lift point for a vehicle being raised. A method for utilizing a service jack of this type includes the steps of positioning the jack with the lift arm in its lowered position adjacent the vehicle in the vicinity of the selected lift point, locating the selected lift point as a reflected image in the mirror, and moving the jack while elevating the lift arm so as to maintain the selected lift point as a reflected image in the mirror until the saddle engages the selected lift point.

10 Claims, 4 Drawing Sheets

AUTOMOTIVE SERVICE JACK

CROSS-REFERENCE TO RELATED APPLICATION

This application is a continuation in part of U.S. patent application Ser. No. 08/790,917, filed Jan. 29, 1997, now abandoned.

BACKGROUND OF THE INVENTION

The present invention relates to portable automotive lifting devices of the service jack type, such as rolling jacks, trolley jacks and double arm pivot parallelogram jacks.

Service jacks are well known, and are defined in ASME PALD-1993, Part 10, as "a self-contained device designed for lifting, but not sustaining, a partial vehicular load, consisting of a frame with wheels and/or swivel casters supporting a mechanism that actuates a pivoting lift arm equipped with a saddle." Conventional service jacks are not entirely satisfactory in that they commonly exhibit one or more of the following disadvantages:

1. When the service jack is rolled under the body of a vehicle, the lift arm saddle, which engages the vehicle at the lift or jacking point (hereinafter, the "lift point") so as to raise the vehicle is partially or entirely obscured from the view of the operator.
2. The operator, when in a standing position, cannot see the lift point on the underside of the vehicle so as to properly locate the saddle for engagement with the lift point.
3. Modern vehicles have tightly defined lift points located on the frame, the unibody joints, the subframe and/or suspension parts. Attempting to raise the vehicle at the wrong point may result in damage to underside areas of the vehicle which are not structurally designed to function as lift points.
4. In order to align the jack with a lift point of the vehicle, the operator must get down in a hands and knees position to look under the body of the vehicle to manipulate the typically heavy service jack into the proper position.
5. In the hands and knees position, the view of the underside of the vehicle is from the side, instead of from below looking up at the vehicle underside so as to be able to positively locate the lift point.
6. If the service jack is located under the vehicle without the proper visual alignment, the saddle may either (a) lift against a part of the vehicle not designed to carry the weight of the vehicle, thereby damaging the vehicle or (b) be seated on an angled or slippery component of the vehicle, which may result in the vehicle suddenly sliding off of the jack, thereby creating a safety hazard.

Thus there is a need for an improvement in the conventional service jack to enable the operator to indirectly view the underside of a vehicle from a standing position while positioning the saddle so as to avoid these disadvantages of the prior art service jacks.

BRIEF SUMMARY OF THE INVENTION

With respect to the apparatus aspects of the present invention, a service jack for facilitating the raising of a vehicle at a selected lift point by permitting the indirect viewing of the lift point during operation of the jack has a wheeled frame with a lift arm which terminates in a saddle at one end and is pivotally attached to the frame at the other end, with lift arm actuating means selectively operable to move the lift arm with respect to the frame between an raised position and a lowered position, and includes mirror means attached to the lift arm and disposed so as to provide a reflected image of a sector of space above the saddle as the lift arm is moved from the lowered to the raised position.

The method aspects of the present invention for facilitating the raising of a vehicle at a selected lift point by indirectly viewing the lift point during the actuation of a service jack utilized to raise the vehicle at the selected lift point comprises the steps of disposing a mirror on the service jack's lift arm upper surface adjacent its saddle, positioning the service jack with the lift arm in its lowered position adjacent the vehicle in the vicinity of the selected lift point, locating the selected lift point as a reflected image in the mirror, elevating the lift arm until the saddle engages the selected lift point while moving the jack so as to maintain the selected lift point as a reflected image in the mirror, and completing the elevation of the lift arm while the saddle continues to engage the selected lift point.

BRIEF DESCRIPTION OF THE DRAWING

The present invention may be more readily understood by referring to the accompanying drawing, in which.

DETAILED DESCRIPTION OF THE PREFERRED EMBODIMENT

Figure 1:
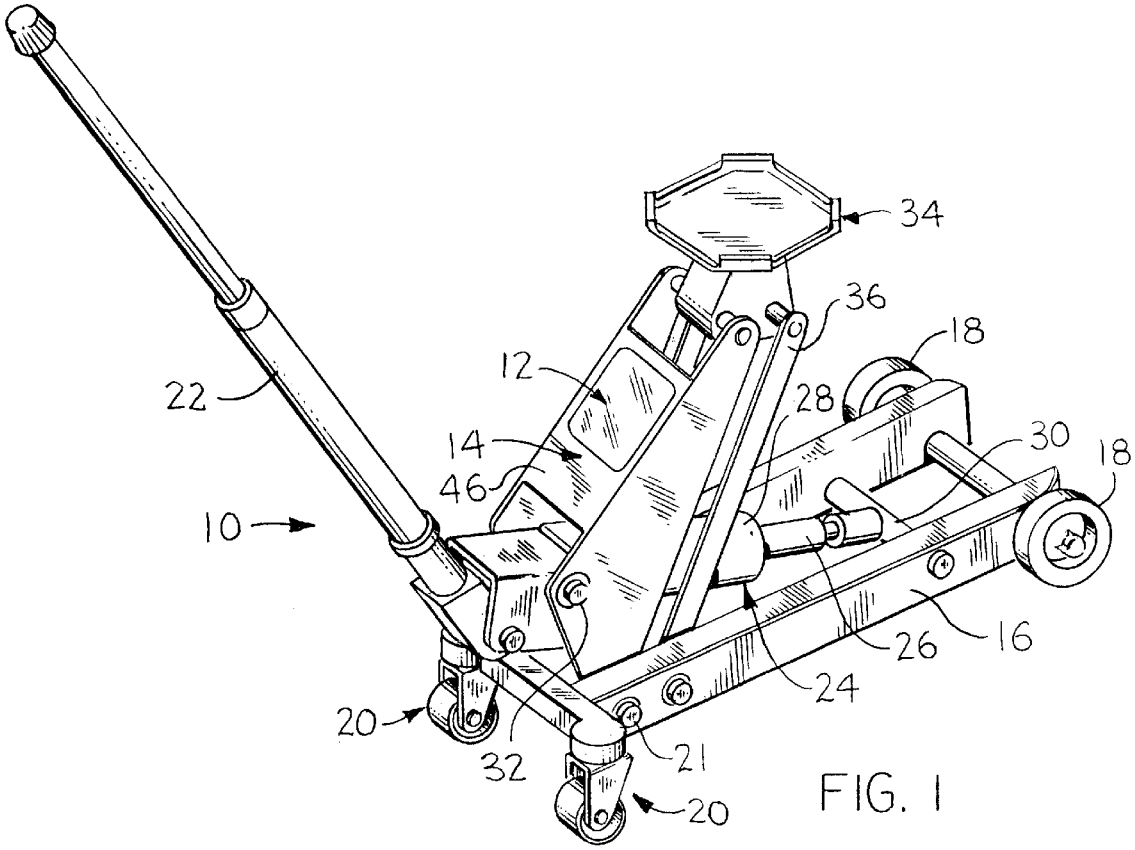
FIG. 1 is an isometric view of a service jack according to the present invention when the jack is in its lift arm raised position.

Referring now to FIG. 1, a service jack 10, according to the present invention, has a mirror assembly 12 mounted on a lift arm 14. Except for the inclusion of the mirror assembly 12 on lift arm 14, the service jack 10 is of conventional construction, and, as illustrated, is of the hydraulic type. However, a service jack according to the present invention may be of any of the hydraulic, mechanical, pneumatic/hydraulic or pneumatic types, and the hydraulic service jack 10 is shown in the accompanying drawing solely for purposes of ease of illustration of the present invention, and not by way of a limitation as to the applicability of the invention.

The service jack 10 has a generally rectangular frame 16, at one end of which a pair of wheels 18 are attached. At the opposite end of the frame 16, a pair of casters 20 are attached. The lift arm 14 is pivotally attached to the frame 16 by pins 21 in the conventional manner. A handle 22 is attached to the frame 16 between the casters 20, and is utilized to operate a hydraulic cylinder assembly 24 which is connected between the frame 16 and the lift arm 14 in conventional fashion. The hydraulic cylinder assembly includes a piston rod 26 extending out of a hydraulic cylinder 28 and attached to a pivotal cross bar 30 extending across the frame 16 adjacent the wheels 18. The hydraulic cylinder 28 is attached to the lift arm 14 by a pivot pin 32. The handle 22 is used by an operator to actuate the hydraulic cylinder assembly in conventional fashion to cause the lift arm 14 to be selectively raised and lowered.

The service jack 10 has a saddle 34 which is pivotally attached to the lift arm in conventional fashion. A pair of self-leveling arms 36 (only one of which is shown in FIG. 1) are pivotally connected between the rectangular frame 16 and the saddle 34 in alignment with the lift arm 14 so as to maintain the saddle 34 in a level, upright position in conventional fashion during the raising and lowering of the lift arm 14.

Figure 2:
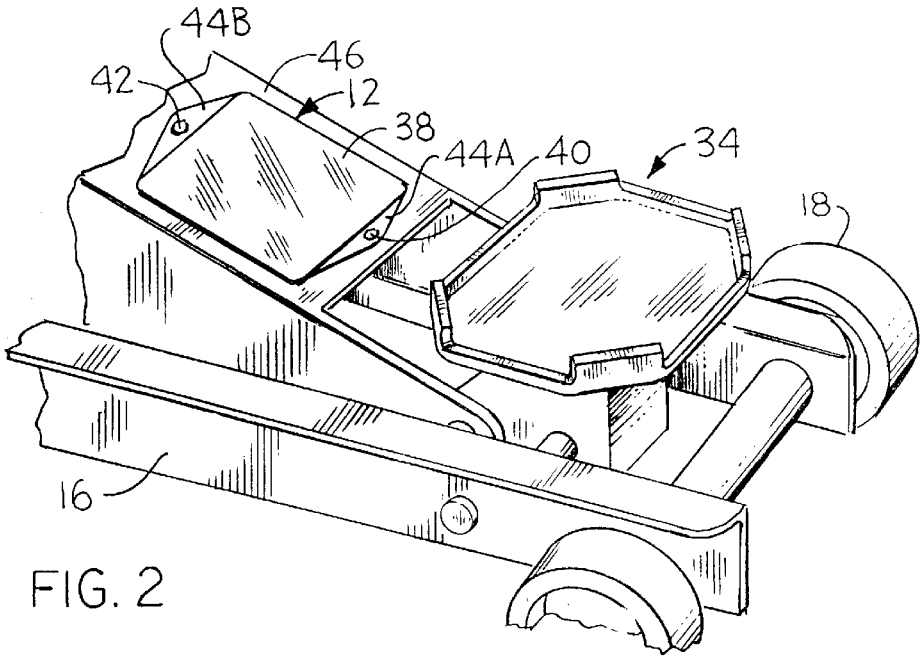
FIG. 2 is a partial isometric view of the jack of FIG. 1 when in its lift arm lowered position, illustrating the relationship of the saddle and lift arm mirror.

FIG. 2 is a partial view of the service jack 10 illustrating the preferred disposition of the mirror assembly 12 on the lift arm 14 as adjacent the saddle 34.

Figure 7:
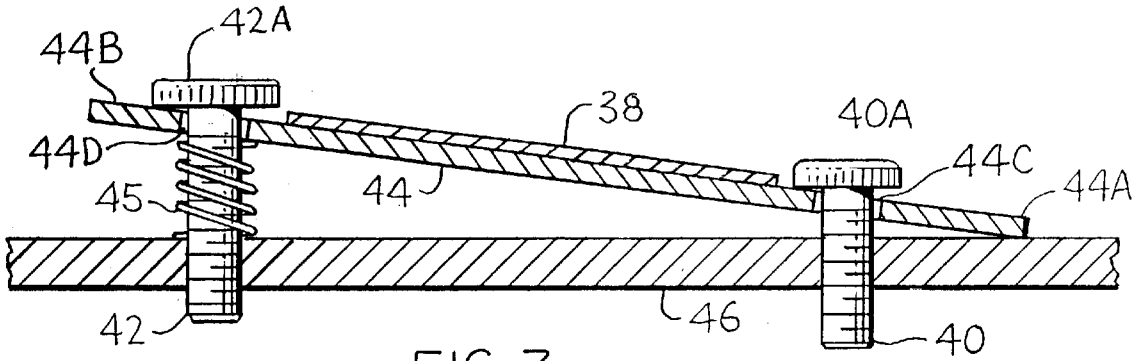
FIG. 7 is a partial side elevation, in section, illustrating the preferred embodiment of the adjustable mirror assembly of the present invention.

The preferred embodiment of the mirror assembly 12 is shown in FIGS. 2 and 7, and includes a mirror element 38 which is attached to the lift arm 14 by a pair of threaded mirror angle adjusting bolts 40,42 bolts which pass through opposite ends 44A,44B of a mirror element base 44 bearing the mirror element 38. The bolts 40,42 pass through mirror element base apertures 44C,44D, respectively so as to be freely rotatable with respect to the mirror element base 44. The bolts 40, 42 threadably engage the lift arm on its face 46 by means of threaded apertures formed therein. A spring 45 is disposed about the mirror adjusting bolt 42 between the mirror base 44 and the lift arm face 46 so as to urge the mirror element end 44B away from the lift arm face 46 and against a head 42A on the bolt 42. The mirror adjusting bolt 42 is selectively rotated to change the angle between the lift arm face 46 and the mirror element base 44 so as to provide for the selection of the desired angle of incidence between of the mirror element 38 with the line of sight of one who is operating the service jack 10. The mirror adjusting bolt 40 is rotated as requires to accommodate the contact of the mirror element end 44A with the lift arm face 46 and a head 40 a on the bolt 40. The selection of this angle of incidence provides for the selection of a desired sector of the underside of the vehicle to be indirectly viewed for location of the selected lift point.

It will be obvious to those skilled in the art that this structure is exemplary only as to the structure required to provide for an adjustable mirror assembly, and that numerous variations or modifications thereof will be obvious which will provide the same feature of adjustability. Alternatively, the mirror element 38 can be permanently fixed directly to the lift arm face 46 at a position selected with respect to the lift arm and saddle geometry so as to provide a satisfactory viewing angle during jack operation, although such a fixed mirror embodiment may require some additional head or body movement on the part of the operator to further adjust the viewing angle during the jack operation.

Figure 3:
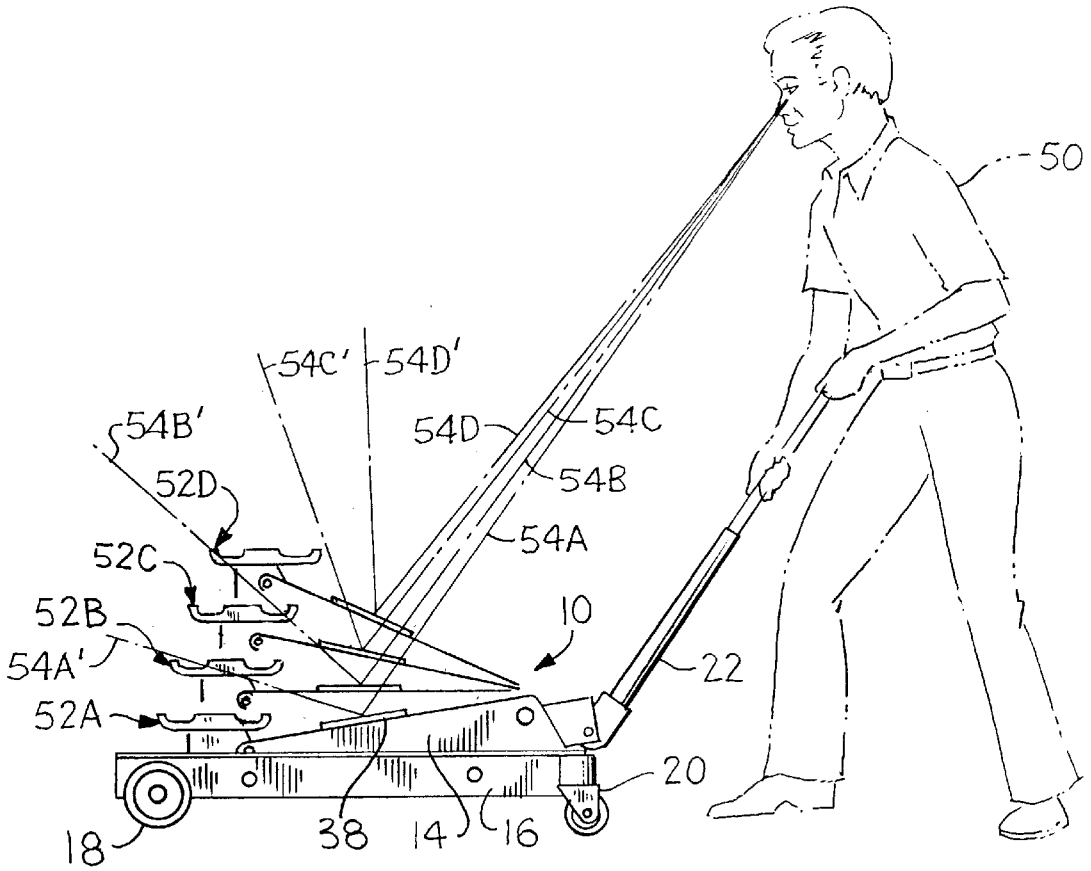
FIG. 3 is a left side elevational view of the jack of FIG. 1, illustrating the relative positions of the saddle and lift arm mirror as the lift arm moves between its lowered and raised positions.

Referring now to FIG. 3, the service jack 10 is shown as being moved by an operator 50, shown in broken lines, from its retracted position 52A through two intermediate positions 52B,52C to its extended position 52D. In FIG. 3 the change in the angle of incidence during the jack operation is illustrated by broken lines 54A,54B,54C,54D, representing the line of sight between the operator 50 and the mirror element 38 at its center for the various positions of the lift arm 14 illustrated in FIG. 3. As is apparent in FIG. 3, the operator 50, when looking at the mirror element 38, will see a reflected image of whatever object is located on the opposite side of the mirror element 38 at the same angle with the mirror element (the "angle of reflection") as the angle of incidence. Thus, as is shown by FIG. 3, the pivotal raising of the lift arm 14 will provide for a panoramic scanning by the operator 50 of the service jack 10 of a sector of space beyond the mirror element 38, illustrated by the broken lines 54A',54B',54C',54D'. This panoramic scanning function is utilized by the operator 50 to select an appropriate lift point on a vehicle, position the jack 10 under the vehicle so that the saddle 34 will engage the selected lift point, and observe the continued engagement of the saddle 34 and the selected lift point during the operation of the jack 10. This procedure for utilizing the jack 10 according to the present invention is illustrated in FIGS. 4, 5 and 6.

Figure 4:
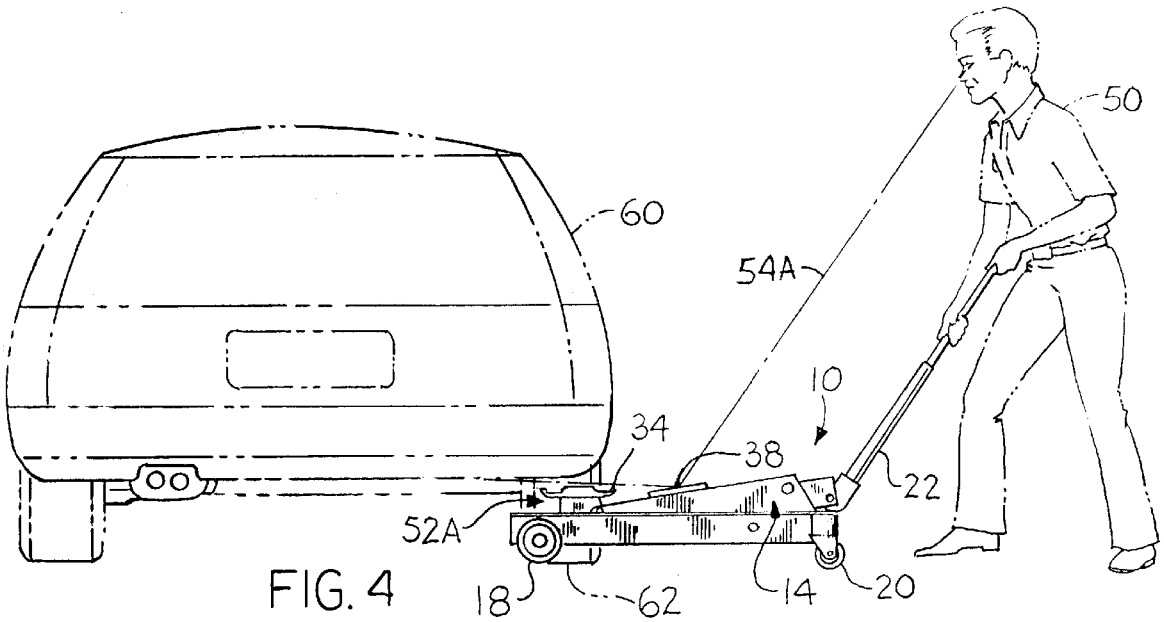
FIG. 4 is a left side elevational view of the jack of FIG. 1 in its lift arm lowered position, illustrating the line of sight provided by the lift arm mirror to assist the operator in locating a selected lift point on a vehicle.

In FIG. 4, the service jack 10, shown with its lift arm 14 in its lowered position illustrated in FIG. 3 as position 52A, is being positioned at the rear of a vehicle 60, the body of which is shown in broken lines and the undercarriage of which is shown in solid lines. The operator 50 is positioning the jack 10 adjacent its right rear wheel 62 so that the operator 50, when looking at the mirror element 38, sees the reflected image of the underside of the vehicle 10 in order to locate a selected lift point. The operator 50 then moves the jack 10 as may be required under the vehicle 60 until the selected lift point appears as a reflected image on the mirror element 38.

When the selected lift point is seen in the mirror 38, the operator commences the operation of the jack 10. The operator 50 maintains the image of the selected lift point in the mirror 38 during the initial portion of the initial operation by pushing the jack 10 further under the vehicle 60. Otherwise, the image may be lost by reason of the change in the angle of incidence, and consequently the angle of reflection, caused by the raising of the lift arm 14, as was illustrated in FIG. 3.

Figure 5:
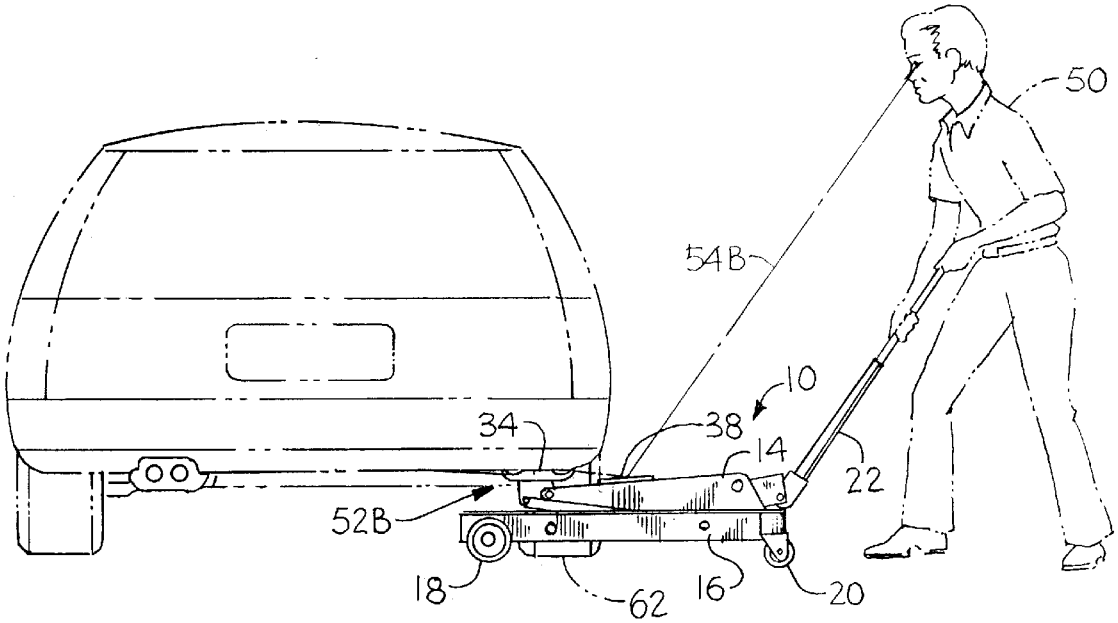
FIG. 5 is a left side elevational view of the jack of FIG. 1 with its lift arm in a partially raised position, illustrating the line of sight provided by the lift arm mirror to assist the operator in positioning the saddle under the selected lift point on the vehicle prior to engagement of the saddle and lift point.
Figure 6:
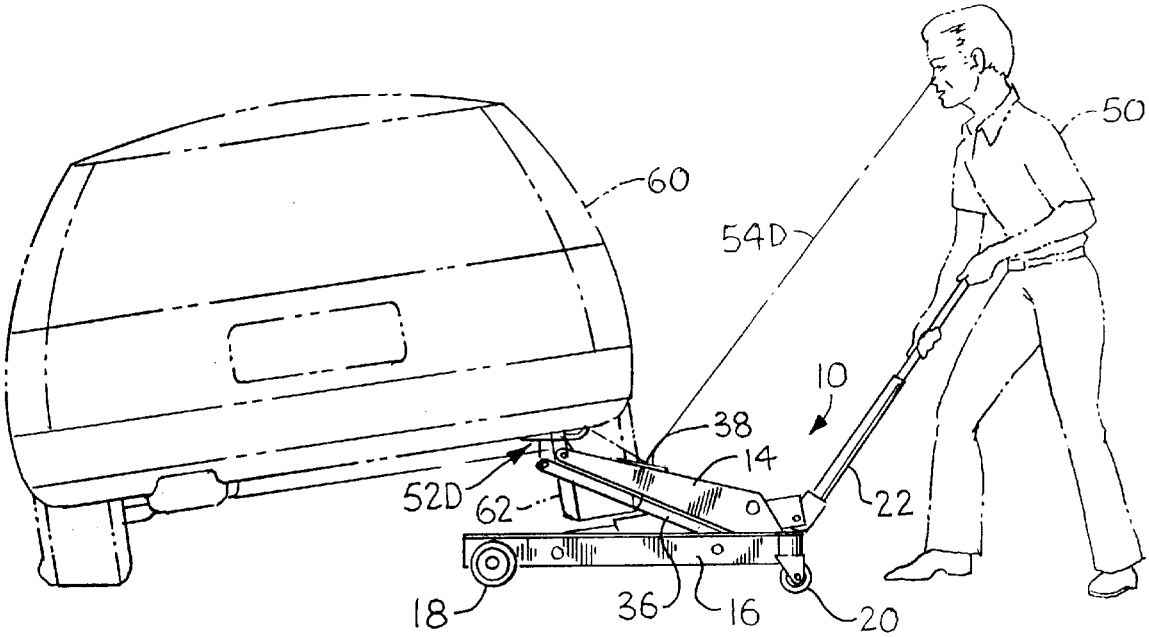
FIG. 6 is a left side elevational view of the jack of FIG. 1 with its lift arm in the raised position, illustrating the line of sight provided by the lift arm mirror to assist the operator in ensuring that the saddle continues to engage the selected lift point on the vehicle during the raising of the vehicle.

In FIG. 5, the operator 50 has located the selected lift point, and has pushed the jack 10 further under the vehicle 60 while raising the lift arm 14 to which the mirror element 38 and saddle 34 are attached to keep the selected lift point in view in the mirror element 38. The operator 50 is now able to see in the mirror element 38 that the saddle 34 is properly located with respect to the selected lift point so that, upon further operation of the jack 10 to lift the lift arm 14, the saddle 34 will properly engage the selected lift point.

The operator 50 then continues with the jacking operation, causing the saddle 34 to engage the selected lift point so as to lift the desired portion of the vehicle 60 from its supporting surface (not shown). The operator 50 is able to continue to observe the contact between the saddle 34 and the selected lift point as the vehicle 60 is raised by monitoring the reflected image in the mirror element 38. This procedure is illustrated in FIG. 6, in which the right rear wheel 62 and adjacent portion of the vehicle 60 are seen to have been lifted from the supporting surface (not shown).

As used herein, the term "mirror" is used in its broadest sense as comprehending any image reflecting device, whether reflective, per se, or comprised of a substrate onto which a reflective medium has been disposed by whatever means. Also, the terms "lowered" and "raised" with reference to the positioning of the lift arm are used in a relative sense with respect to one another, and so are not necessarily limited to positionings at the lower limit position and the upper limit position of the lift arm.

While the presently preferred embodiment of the invention and certain modifications thereof have been described above, other modifications, substitutions and alternatives with respect to the preferred embodiment will be apparent to those skilled in the art without departing from the scope of the present invention as defined by the claims hereof.

The invention claimed is:

1. In a service jack, the combination of:

a wheeled frame, a lift arm having a longitudinally extending upper surface, said lift arm being pivotally attached to the frame at one end thereof and terminating in a saddle at the other end thereof, lift arm actuating means selectively operable by an operator to move the lift arm with respect to the frame between a raised position and a lowered position, a mirror element, and means for disposing said mirror element on the lift arm upper surface so as to provide a vertically reflected image of a sector of space above the saddle for the operator when positioned in longitudinal alignment with the mirror element as the lift arm is moved from its lowered to its raised position.

2. A service jack according to claim 1, and in which said mirror element is disposed generally adjacent to the saddle.

3. A service jack according to claim 1, and in which said mirror element is permanently fixed to the lift arm on the lift arm's upper surface.

4. A service jack according claim 2, and in which said mirror element is permanently fixed to the lift arm on the lift arm's upper surface.

5. A service jack according to claim 1, and in which said mirror element is attached to the lift arm so as to be selectively angularly adjustable longitudinally with respect to the lift arm by the operator, whereby said mirror element is selectively adjustable in order to optimize the reflected image sector provided to the operator as the lift arm is moved from its lowered to its raised position.

6. A service jack according to claim 5, and in which the mirror attaching means includes at least one bolt which rotatably engages said mirror means and threadably engages the lift arm at its upper surface.

7. A service jack according to claim 5, and in which said mirror element is disposed generally adjacent to the saddle.

8. A service jack according to claim 6, and in which said mirror element is disposed generally adjacent to the saddle.

9. A method for the utilization of a service jack of the type having a wheeled frame to which a lift arm having a longitudinally extending upper surface terminating in a saddle is pivotally connected for the raising a vehicle at a selected lift point of the vehicle comprising:

disposing a mirror on the lift arm upper surface adjacent the saddle, positioning the service jack with the lift arm in its lowered position adjacent the vehicle in the vicinity of the selected lift point, locating the selected lift point as a vertically reflected image in the mirror while the operator is positioned in longitudinal alignment with the mirror on the lift arm upper surface, commencing the elevation of the lift arm, and continuing the elevation of the lift arm while maintaining the selected lift point as a vertically reflected image in the mirror until the saddle engages the selected lift point.

10. The method of claim 9, and including the step of adjusting the positioning of the mirror on the lift arm with respect to the angle of incidence between the service jack operator's eyes and the mirror prior to the commencement of the elevation of the lift arm in order to optimize the observability of the reflected image of the selected lift point by the operator during the elevation of the lift arm.

* * * * *